US008037796B2

(12) United States Patent
Salva

(10) Patent No.: US 8,037,796 B2
(45) Date of Patent: Oct. 18, 2011

(54) PROCEDURE FOR MANUFACTURING A PELLET FOR SPORTING RIFLE OR SPORTING GUN AND PELLET FOR SPORTING RIFLE OR SPORTING GUN THUS OBTAINED

(76) Inventor: Francisco Casas Salva, Sant Boi De Llobregat (ES)

( * ) Notice: Subject to any disclaimer, the term of this patent is extended or adjusted under 35 U.S.C. 154(b) by 0 days.

(21) Appl. No.: 12/780,450

(22) Filed: May 14, 2010

(65) Prior Publication Data

US 2010/0224094 A1 Sep. 9, 2010

Related U.S. Application Data

(62) Division of application No. 12/346,022, filed on Dec. 30, 2008.

(51) Int. Cl.
*F42B 33/00* (2006.01)
*F42B 6/10* (2006.01)
*F42B 30/02* (2006.01)

(52) U.S. Cl. ..... 86/54; 102/501

(58) Field of Classification Search ..... 86/54, 55; 102/502, 503, 507, 508, 517, 509, 510, 519, 102/529, 501
See application file for complete search history.

(56) References Cited

U.S. PATENT DOCUMENTS

| | | | | |
|---|---|---|---|---|
| 577,183 | A | 2/1897 | Borchardt | |
| 1,493,614 | A | 5/1924 | Dickerman | |
| 1,556,160 | A | 6/1925 | Riggs | |
| 2,932,253 | A | 4/1960 | Auxier | |
| 3,019,733 | A | 2/1962 | Braid | |
| 4,805,536 | A | 2/1989 | Kosteck | |
| 5,183,963 | A * | 2/1993 | Beaufils et al. | 102/515 |
| 5,760,329 | A * | 6/1998 | Baum et al. | 102/439 |
| 6,244,186 | B1 | 6/2001 | Pichard | |
| 6,363,856 | B1 * | 4/2002 | Stoker et al. | 102/516 |
| 6,405,654 | B1 | 6/2002 | Smith | |

(Continued)

FOREIGN PATENT DOCUMENTS

| | | |
|---|---|---|
| CA | 990136 | 6/1976 |

(Continued)

OTHER PUBLICATIONS

Spanish Search Report for Application No. ES 2 304 898 dated Sep. 22, 2008 filed with IDS of Feb. 20, 2009 in U.S. Appl. No. 12/346,022.

(Continued)

*Primary Examiner* — Bret Hayes
*Assistant Examiner* — Reginald Tillman, Jr.
(74) *Attorney, Agent, or Firm* — Kilpatrick Townsend & Stockton LLP

(57) ABSTRACT

A pellet for a sporting rifle or a sporting gun includes a body and a tip that are joined together. A lower portion of the body includes a first internal cavity, and a head of the body includes a second internal cavity. The tip includes an upper part ending in at least one vertex and a lower part, the upper and lower parts being joined at their bases. The lower part of the tip is received in the second internal cavity. A portion of the head may be crimped around the tip to hold the tip inside the second internal cavity of the body. An outer hoop may be formed on the tip, and the portion of the head that is crimped may be crimped above the hoop to securely hold the tip in the body.

20 Claims, 6 Drawing Sheets

U.S. PATENT DOCUMENTS

| | | | | |
|---|---|---|---|---|
| 6,526,893 | B2 * | 3/2003 | Phillips et al. | 102/508 |
| 7,299,750 | B2 * | 11/2007 | Schikora et al. | 102/506 |
| 2002/0100389 | A1 | 8/2002 | May et al. | |
| 2005/0005807 | A1 * | 1/2005 | Wiley et al. | 102/517 |

FOREIGN PATENT DOCUMENTS

| | | | |
|---|---|---|---|
| DE | 1 917 638 | | 10/1970 |
| EP | 0 262 574 | A1 | 4/1988 |
| EP | 0 636 853 | A1 | 2/1995 |
| EP | 0 918 208 | A1 | 5/1999 |
| EP | 1 264 155 | A | 12/2002 |
| ES | 276 209 | U | 6/1984 |
| ES | 291472 | | 12/1985 |
| ES | 2 227 128 | | 4/2005 |
| FR | 373 597 | | 5/1907 |
| FR | 2 574 921 | A2 | 6/1986 |
| GB | 2 052 693 | A | 1/1981 |
| GB | 2 110 347 | A | 6/1983 |
| GB | 2 131 925 | A | 6/1984 |
| WO | WO 2004/053423 | A1 | 6/2004 |

OTHER PUBLICATIONS

International Search Report and Written Opinion of the International Searching Authority dated May 20, 2009 for International Application No. PCT/IB2008/054884.

Office Action from U.S. Appl. No. 12/346,022, dated Mar. 2, 2010.

* cited by examiner

PROCEDURE FOR MANUFACTURING A PELLET FOR SPORTING RIFLE OR SPORTING GUN AND PELLET FOR SPORTING RIFLE OR SPORTING GUN THUS OBTAINED

CROSS REFERENCES TO RELATED APPLICATIONS

This application is a divisional application of U.S. patent application Ser. No. 12/346,022, filed on Dec. 30, 2008, which claims priority to Spanish Patent Application No. 2 304 898, filed on Mar. 3, 2008, each of which is incorporated herein by reference in its entirety.

BACKGROUND

A procedure for the manufacture of a pellet for sporting rifle or sporting gun and pellet for sporting rifle or sporting gun thus obtained, of the type comprising: a first stage in which a pellet is arranged on a support in which the former comprises a body with an internal cavity and a head with an internal cavity having sufficient size to house at least part of a tip inside, characterised in that it comprises the following stages: a second with a tip, formed by an upper part, ending in at least one vertex and a lower ending part, joined by their bases and said lower part facing the mentioned internal cavity of the head, a third stage in which said tip is allowed to fall inside the internal cavity impacting on the lower part of the tip inside the internal cavity and positioning itself inside the mentioned internal cavity and a fourth stage in which the head is crimped, at the same time crimping and fixing said head to the tip; with said internal cavity comprising the form of a solid mould or a revolution solid, the faces of which converge at a point or a trunk of said solid or revolution solid.

The inventor is known in the sporting rifle sector as a great inventor, especially with respect to air and $CO_2$ rifles or pistols. Within this line of improvement, this patent refers to the employed ammunition.

Thus, European Patent, EP0636853 "Bullet for handguns" from 1983 is known which describes a bullet or projectile for firearms comprising a cylindrical metal body, a front designed as a spinner from top to bottom and an open hole at the front. An additional ballistic body is inserted into the hole, projecting beyond the front of the body and in the form of a sphere that can be elastically compressed and made of impact-resistant material. The hole in the body (which is made of strong material) contains an extension that is spherical in its front or external section, the radius of curvature of which is less than the inserted radius of curvature.

British Patent, GB2110347 "A pellet for an air, gas or spring operated gun" from 1993, presents a pellet for a compressed air or gas pistol comprising a front part, a metal ball and a skirt part made of lead, the front part is at least partially integrated into the skirt part to be firmly coupled there, the ball that forms the front part is made of a stronger metal than that used to form the skirt part an preferably copper or steel.

Among the inventions registered in Spain, above all, Utility Model U0276709 "Balin perfeccionado, para armas de aire comprimido" from 1984 should be emphasised. The claimed pellet is made up of two different parts, one of which adopts a generally cylindrical configuration and preferably made of plastic, which defines a cavity in which the second part is positioned and retained that is preferable spherical and made of steel. In correspondence with the mouth of the cavity, the cylindrical part presents an internal annular rib that defines a narrowing of this mouth in order to form a retention means for the spherical steel part.

Another document group includes inventions of pellets or projectiles with conical top.

We point out British Patent GB2131925 "Projectile" of 1984, which claims a projectile for use in compressed air firearms that comprises a bullet made from synthetic plastic having a part of a cylindrical body that comes to a point at the front. It provides a hollow cavity in the shaft of the bullet and a weight located in the cavity to provide projectile trajectory stability. The lower part of the bullet shaft projectile includes longitudinal cavities.

There is background that goes much further back in time that claim the introduction of the ball at the projectile top. Thus, in French Patent FR373597 "Arquebuserie et artillerie" of 1907 described a projectile, the top of which incorporated a ball in the upper part and, in another example, incorporated an arrow-shaped body.

Another example of this invention is a U.S. Pat. No. 1,556,160 "Game bullet" of 1924 presenting a bullet with a solid strong metal body and a soft metal plug that adapts to a cavity formed in the upper part of the bullet. As a result of the bullet impacting on the obstacle, the plug performs the mushroom effect, while the bullet is deformed.

German Patent DE1917638 "Kugel fur Luft-oder dergleichen Gewehre" of 1970 refers to a pellet with a filling in the upper part of the body and the obtuse top. Optionally, the filling can be covered with sheet of soft material.

Canadian Patent CA990136 "Egg cup projectile" from 1976 refers to a projectile with a resin or plastic body with a hollow upper part containing the charge. The conically formed upper part comprises an external surface joined to the body wall.

Also noteworthy is Utility Model U0291472 "Bala expandible para escopeta de caza" from 1986. The bullet comprises a conical profile point and strong material, which is supported on cylindrical lead body, the inside of which has a cavity, also cylindrical and coaxial and a truncated cone cavity in its lower part from which a groove leaves having the same dimensions as the truncated cone projection and the tab carried by the head of the lower projectile body, which is made of plastic, joining the parts together by a stud firmly fixed to the tip that crosses the other two and secures them by a nut on the opposite end.

French patent FR2574921 "One-piece projectile device launched by a portable firearm" form 1986 describes a projectile that consists of a firm metal bullet body, first with soft metal casing that wraps around said bullet and having three fins and then with a lightweight synthetic resin body, conically shaped that stabilises the entire propulsion effect. This invention indicates that an attempt was made to design a projectile with ballistic improvements.

European Patent EP1264155, validated in Spain ES2227128 "Proyectil deformable, pobre en sustancias nocivas, preferiblemente para armas de fuego manuales" from 2005, presents deformable projectile with a front part that conically narrows towards the projectile top and with an essentially cylindrical rear part, in which the projectile comprises a body without sleeve, in which the front part conically narrows, extending a cavity in the centre with respect to the longitudinal axis and with the cavity comprising a cylindrical part and at least one conical part connected to it. A pusher that opens by breaking forms the projectile top, the pusher that opens by breaking of which comprises a head that closes the aperture and a stem.

U.S. Pat. No. 6,244,186 from 2001 "Airgun pellet" as the invention object, described an improved pellet that is basically characterised by two improvements. The first improvement comprises in a multiple-section edge or hood over the head enlarges or multiplies after impact. The second improvement comprises a central conductor point over the head inside the hood. The combination of these two improvements, indicates the patent, provides a cynegetic effect that causes this pellet to improve its penetration, the shockwave and tissue destruction.

U.S. Pat. No. 6,526,893 "Polymer ballistic-tip pellets" in the name of Mr Thomas May and Mr Lee Phillips, refers to pellets with polymer tips for use in air compressed pistols and similar. The pellets have tips sharpened made of a polymer material. The top is formed by a part in fashioned to tip located at least partially outside and a hidden part that is joined to the point at its base, with a cylindrical configuration. The pellet cavity comprises an annular body for the positioning and securing of the hidden part of the tip. Subsequently said cylinder should be secured by adhesive or similar in the annular cavity.

Finally, we cite U.S. Pat. No. 6,405,654 "Muzzle-loader projectile with a plastic insert" from 2002. The purpose of said patent is improved ammunition for employed in arms that are loaded through muzzle, in which the invention is a muzzle-loading projectile that is considerable conventional in overall aspect to previous projectiles of the state of the art, but is considerably different because it has a plastic centre extending to the projectile top, thus producing a lightweight, aerodynamic projectile that has a higher muzzle velocity and a more precise trajectory. Moreover, said projectile construction enables more kinetic energy to be transmitted to the objective thanks to its flattening into a mushroom shape.

SUMMARY OF THE INVENTION

This invention is an improvement in the ammunition sector for sporting rifles and pistols based on compressed air or $CO_2$.

The manufacturing problems associated with ammunition with tip are well known. As shown by the disclosure of the invention, the problem lies in how to manufacture them in large quantities, with hardly any human intervention. It is very often necessary for an operator to finish securing the point inside the pellet. The problem is due to the fact that the annular cavities make automation very difficult and also, said tip has to glued or welded to the pellet body and this increases costs.

If automation is preferred, versions with a sphere instead of a tip are required, which means that its penetration capability and its impact is lower.

The inventor has developed a new procedure for obtaining a pellet which combines, on the one hand, the advantage of being able to employ automatic manufacture and, on the other, the use of a tip in the pellet.

Thus, an internal cavity is made in the pellet head capable of housing at least part of the tip inside. Said internal cavity is arranged as a tip mould, in other words, it has a shape that allows said tip to fit inside the internal cavity.

When the point is facing the internal cavity, the tip is able to fall so that it enters the internal cavity, leaving part of said tip outside. If the tip part deviates a little, but it falls inside the internal cavity, the actual tip will position itself inside the pellet when it comes into contact with the inclined walls of the internal cavity.

Subsequently, the pellet head is riveted or crimped so that when the head is crimped, the tip is also crimped and left immobilised inside the internal cavity.

As can be seen, its manufacture is very simple and permits a high level of automation and production. To this must be added the advantages of a pellet ending in a tip having greater penetration in the objective.

The aim of this invention is a procedure for manufacturing a pellet for sporting rifle or pistol of the type comprising: a first stage in which a pellet is arranged on a support in which the former comprises a body with an internal cavity and a head with an internal cavity having sufficient size to house at least part of a tip inside, characterised in that it comprises the following stages: a second in which it faces a tip formed by an upper part, ending in at least one vertex and a lower ending part, joined by their bases and said lower part facing the mentioned internal cavity of the head, a third stage in which said tip is allowed to fall inside the internal cavity impacting on the lower part of the tip inside the internal cavity and positioning itself inside the mentioned internal cavity and a fourth stage in which the head is crimped, at the same time crimping and fixing said head to the tip; with said internal cavity comprising the form of a solid mould or a revolution solid, the faces of which converge at a point or a trunk of said solid or revolution solid.

An additional goal of this invention is a pellet for sporting rifle or pistol in accordance with the previously-mentioned procedure of the type comprising a body with an internal cavity and a head with an internal cavity having sufficient size to house at least part of a tip inside, characterised in that it comprises a tip, formed by an upper part, ending in at least one vertex and a lower part, joined by their bases, with said internal cavity having the form of a solid mould or rotation solid, the faces of which converge at a point or a trunk of said solid or revolution solid.

BRIEF DESCRIPTION OF THE DRAWINGS

In order to facilitate the explanation, this report is accompanied by four sheets of drawings on which a practical exemplary embodiment is represented, which is cited as an example not limiting the scope of this invention.

DETAILED DESCRIPTION OF PREFERRED EMBODIMENTS

Figure 1:
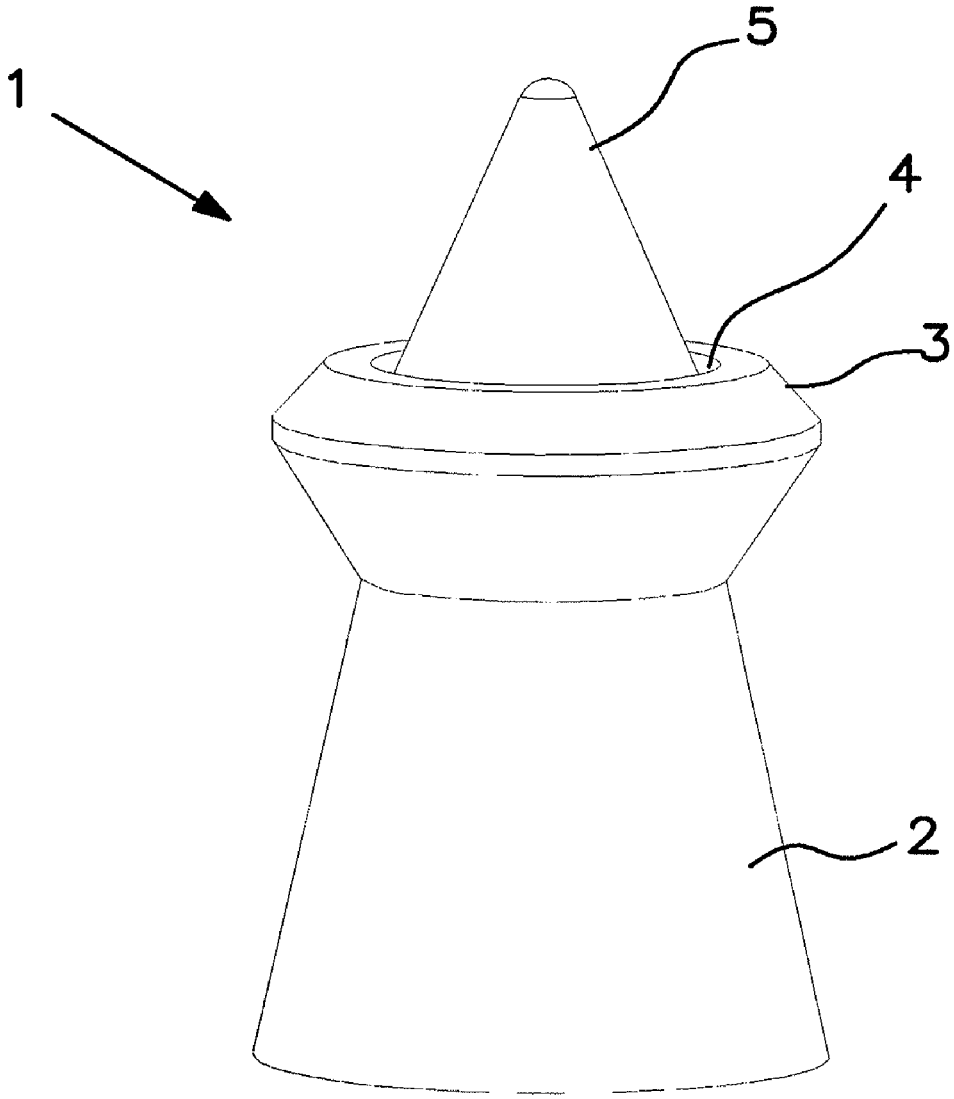
FIG. 1 is a view of the objective of this invention, with the tip in the form of a cone.
Figure 5:
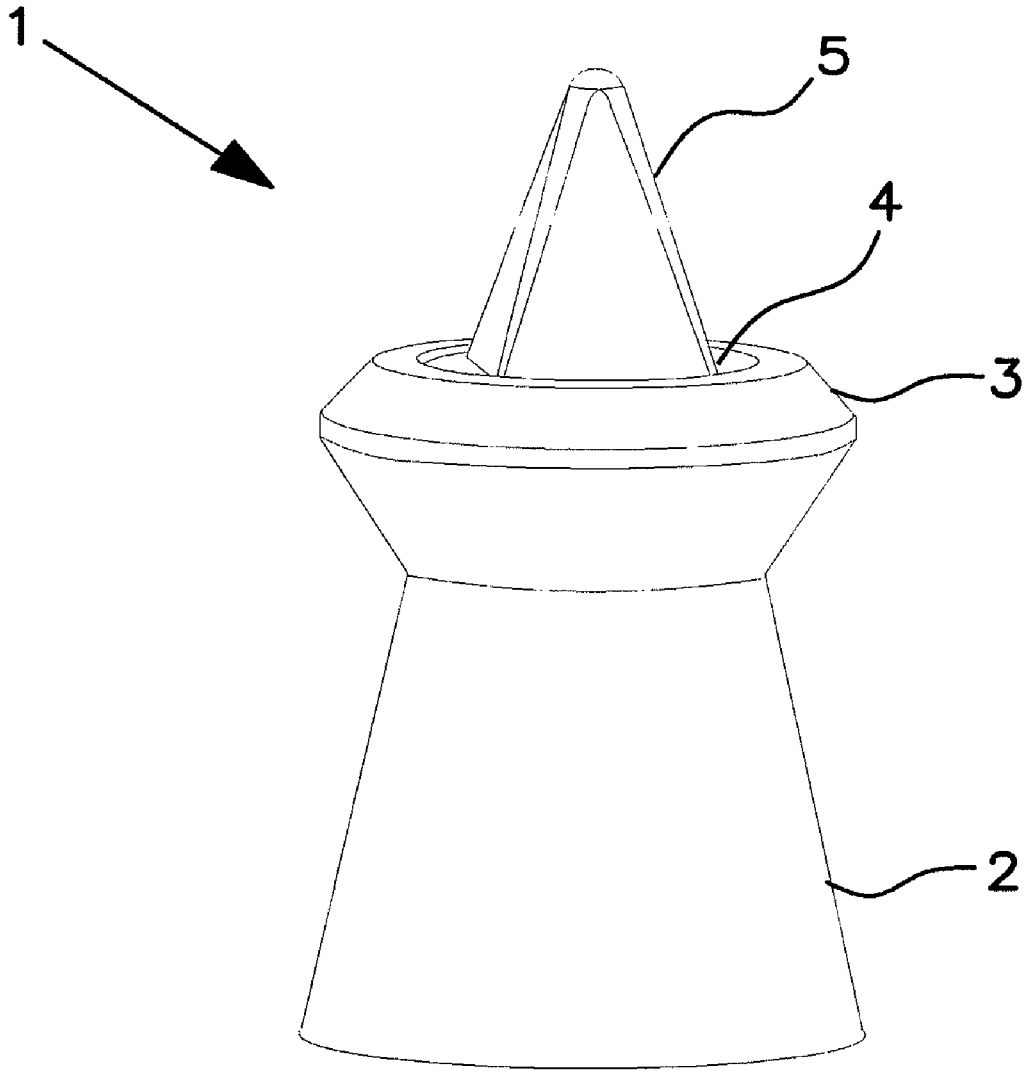
FIG. 5 is a view like FIG. 1, with the tip in the form of a pyramid.

Thus, FIGS. 1 and 5 illustrate a pellet 1, with its body 2 and head 3, an internal cavity 4 of the head and a tip 5.

Figure 2:
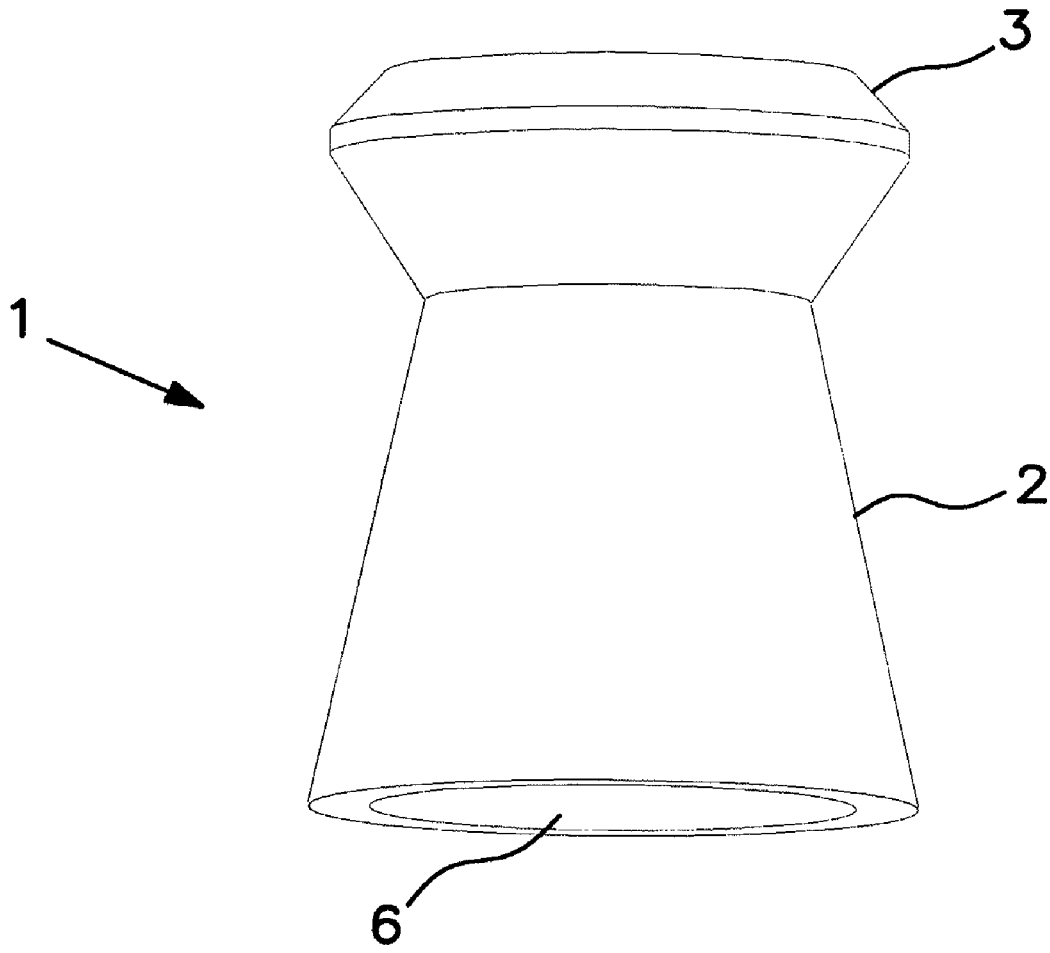
FIG. 2 is a perspective view from below without the tip.

FIG. 2 represents the pellet 1, body 2 with its internal cavity 6 and head 3.

Figure 3:
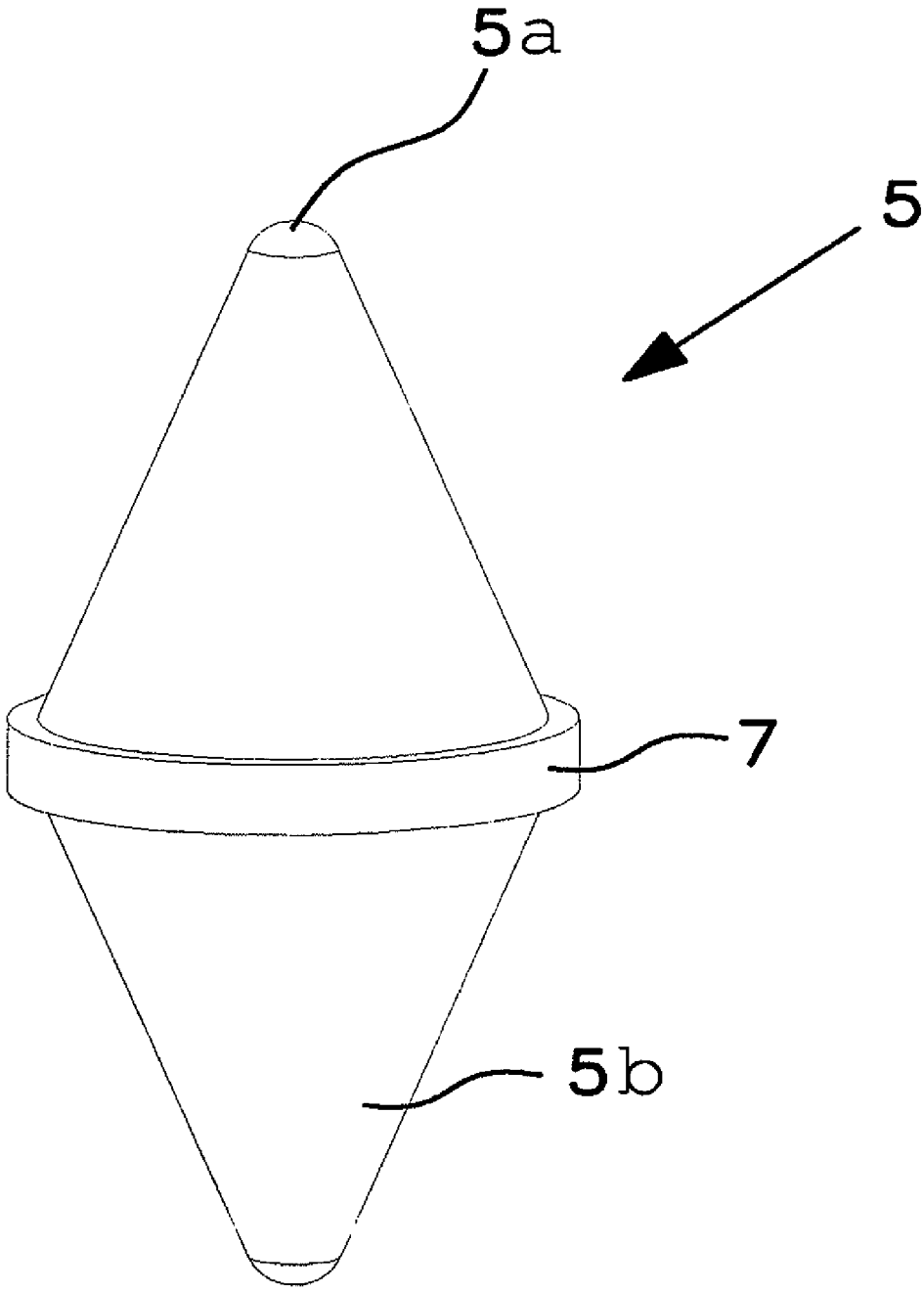
FIG. 3 is a view of the tip of FIG. 1.
Figure 6:
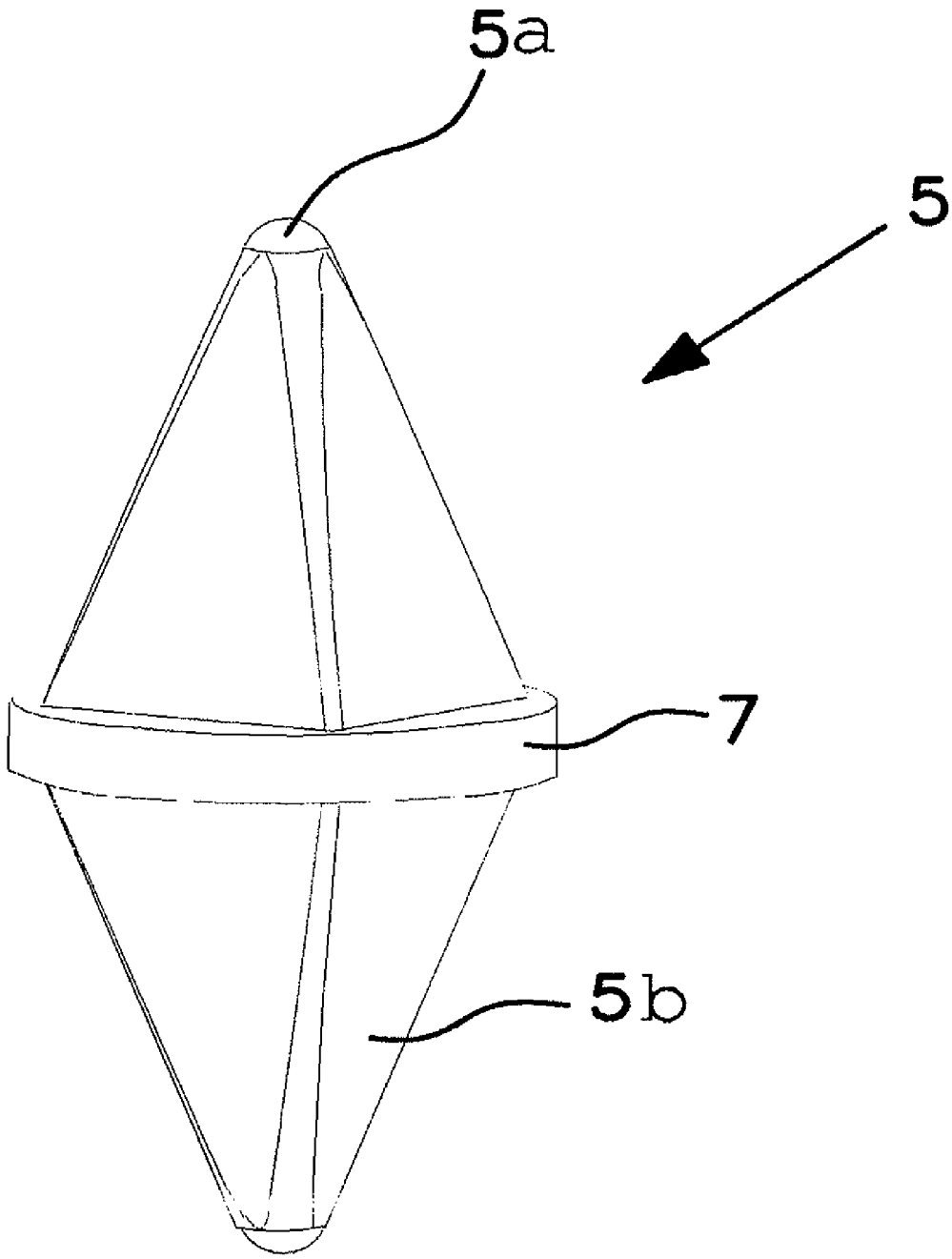
FIG. 6 is a view of the tip of FIG. 5.

FIGS. 3 and 6 show tip 5, with its upper part 5*a*, its lower part 5*b* and a hoop 7.

Figure 4:
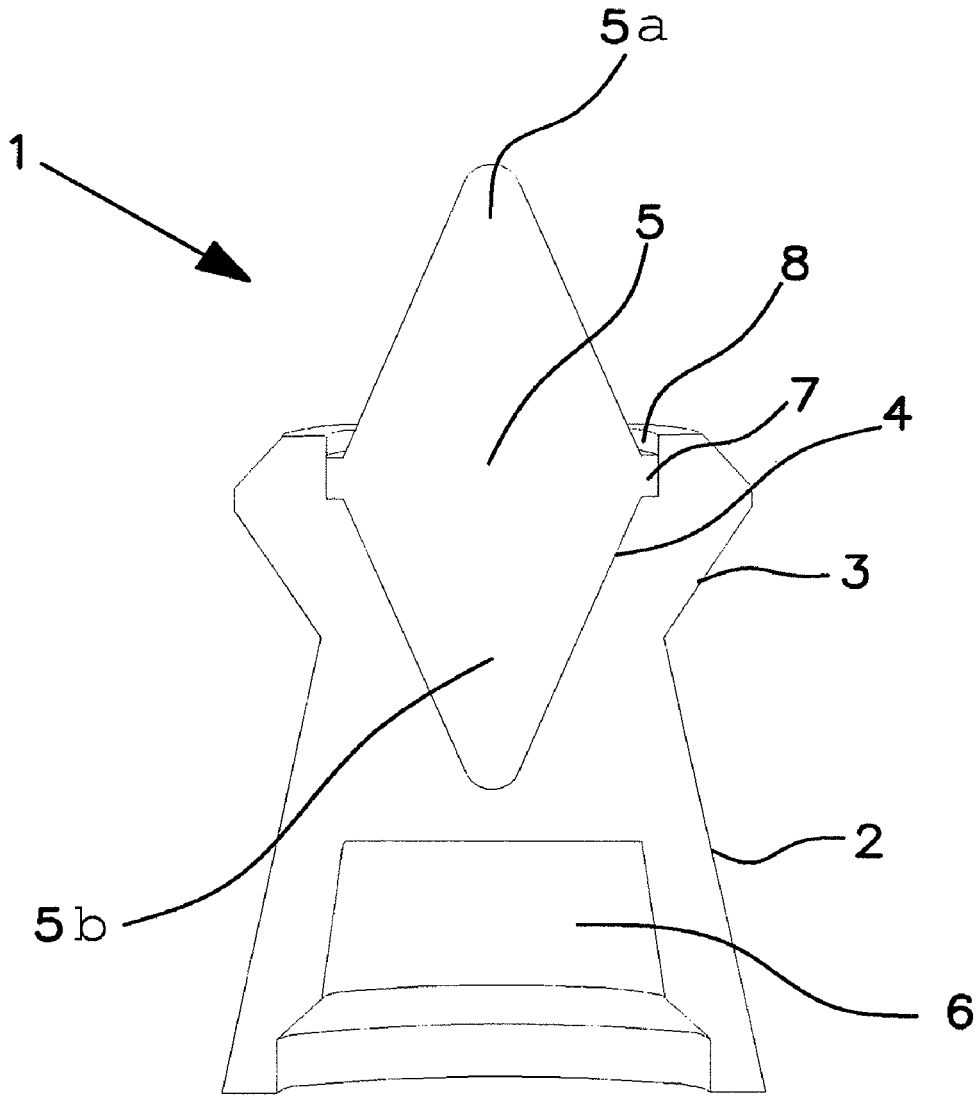
FIG. 4 is a section cut along line IV-IV of FIG. 1.

Finally, FIG. 4 is a drawing of the pellet 1, body 2 and its internal cavity 6, head 3 and its internal cavity 4 and an internal necking 8 and tip 5, with its upper part 5*a* and lower part 5*b* and hoop 7.

In this way, in an exemplary embodiment, the procedure for manufacturing a pellet for sporting rifle or pistol basically consists of four stages: a first stage in which a pellet 1 is arranged on a support. Said pellet 1 comprises a body 2 with an internal cavity 6 and a head 3 with an internal cavity 4 of sufficient size to house at least part of tip 5 inside. This is so because part of the tip must remain outside to impact on the objective.

In the second, tip 5 is faced, formed by an upper part 5*a*, ending in at least one vertex and a lower part 5*b* (in the embodiment ending in a vertex). Said upper 5*a* and lower 5*b* parts are joined together by their bases (FIG. 3).

The vertex of the lower part 5*b* faces the internal cavity 4 of head 3.

In the third stage, said tip 5 is allowed to fall inside the internal cavity 4, with the vertex of lower part 5*b* of tip 5 impacting inside the internal cavity 4, positioning itself inside the mentioned internal cavity 4.

If lower part 5*b* deviates a little, but falls inside the internal cavity 4, the actual point 5 will position itself inside the pellet 1 when it comes into contact with the inclined walls of the internal cavity 4.

In a fourth stage, head 3 is crimped, at the same time, crimping and securing said head 3 to point 5. In fact, this crimping achieves the blocking of any possible exit of point 5 from inside internal cavity 4.

Internal cavity 4 adopts the form of a solid mould or revolution solid, the faces of which converge at a point or a trunk of said solid or revolution solid.

Optionally, point 5 comprises an outer hoop 7 (FIG. 4) and the internal cavity 4 comprises an internal necking 8 in the form of a hoop so that, in the third stage after impacting on the vertex of the lower part 5*b*, said hoop 7 fits into the mentioned necking 8.

FIG. 4 shows a slight inclination of the wall that wraps around hoop 7 subject to said crimping, which prevents the possible exit of tip 5. The mentioned crimping of head 3 onto point 5 is preferably located above hoop 7.

Preferably, internal cavity 4 of head 3 will have the same shape as the lower part 5*b* of the point, thus facilitating the fitting of lower part 5*b* into internal cavity 4.

In principle, upper 5*a* and lower 5*b* parts of the tip, are symmetrical. This facilitates that when tip 5 is facing internal cavity 4, there is no need to ensure which part of tip 5 is facing internal cavity 4. At the same time, if they are symmetrical, manufacturing costs are also reduced. But if required, it is not necessary for them to be symmetrical.

Thus, in accordance with the previously mentioned procedure, the pellet for sporting rifle or pistol comprises body 2, with an internal cavity 6 and head 3 with internal cavity 4 (FIGS. 2 and 3) of sufficient size to accommodate at least part of tip 5 inside.

It also comprises tip 5, formed by an upper part 5*a* ending in at least one vertex and a lower part 5*b* (ending in a vertex in this embodiment, joined at their bases.

Internal cavity 4 adopts the form of a solid mould or revolution solid, the faces of which converge at a point or a trunk of said solid or revolution solid. In other words, it adopts the form of a cone (FIG. 1), or a pyramid (FIG. 5) etc, depending on the type of tip selected.

Optionally, tip 5 comprises an outer hoop 7 and the internal cavity 4 comprises an internal necking 8 in the form of a hoop. Internal necking 8 is used to position outer hoop 7 (FIG. 4). Said outer hoop 7 has a double function, a first that is established after head crimping, which blocks tip 5 preventing it coming out and a second assisting in the positioning of tip 5 in head 3.

The crimping of head 3 over point 5 located above hoop 7.

Internal cavity 4 of the head generally has the same shape as lower part 5*b* of the tip to facilitate the fit, but this could be different because the retaining or blocking of tip 5 in head 3 of the pellet is established by the crimping of head 3 on tip 5.

One of the options is for upper part 5*a* and lower part 5*b* of the tip, to be symmetrical, providing the previously described advantage when tip 5 faces and is allowed to fall into internal cavity 4, it is not necessary to verify whether it is part 5*a* or 5*b* of the tip.

In this embodiment (FIG. 3), it can be seen that upper part 5*a* and lower part 5*b* of tip 5 adopt the configuration of two cones joined at the base, although it could adopt others, such as two pyramids (FIG. 6) etc, provided they are based on a solid or revolution solid, the faces of which converge at a point or a trunk of said solid or revolution solid.

For merely example purposes, test were performed that provided the following results for this pellet, with a weight of 8.2 gr (0.53 g), calibre 0.177 inches (4.5 mm) and fired from a model HUNTER 440 rifle from the applicant company.

| | Barrel Muzzle | 10 yds. (9.14 m) | 30 yds (27.4 m) |
|---|---|---|---|
| Velocity fps (m/s) | 843 (257) | | |
| Kinetic energy ft × lbs (J) | 12.9 (17.5) | | |
| Penetration in paraffin inches (mm) | 0.62 (15.8) | 0.46 (11.7) | 0.42 (10.7) |
| Expansion in paraffin (inches (mm) | 0.29 (7.4) | 0.26 (6.6) | 0.24 (6.1) |
| Grouping diameter inches (mm) | | 0.59 (15) | |

This invention patent described a new procedure for the manufacture of a pellet for sporting rifle or pistol and the pellet for sporting rifle or pistol thus obtained. The examples mentioned here do not limit this invention and thus, can have various applications and/or adaptations, all of which are within the scope of the following claims.

The invention claimed is:

1. A pellet for a sporting rifle or a sporting gun, comprising:

a body having a first internal cavity and a head with a second internal cavity, wherein the second internal cavity has the form of a solid mould or a revolution solid, the faces of which converge at a point or a trunk of said solid mould or revolution solid at a lower, interior portion of the second internal cavity;

a tip having an upper part ending in at least one vertex and a lower part, wherein the upper part and lower part adopt the configuration of two cones joined at bases thereof, and wherein the lower part of the tip is received in the second internal cavity.

2. A pellet in accordance with claim 1, characterised in that the tip comprises an outer hoop and the second internal cavity comprises an internal neck in the form of a hoop such that the outer hoop of the tip is received in the internal neck.

3. A pellet in accordance with claim 2, wherein a portion of the head is crimped around a portion of the tip located above the hoop of the tip.

4. A pellet in accordance with claim 1, wherein the second internal cavity has substantially the same shape as the lower part of the tip.

5. A pellet in accordance with claim 1, wherein the upper part of the tip and the lower part of the tip are symmetrical.

6. A pellet for a sporting rifle or a sporting gun, comprising:

a body comprising a first internal cavity and a head comprising a second internal cavity, wherein the second internal cavity comprises at least one side that is tapered such that the second internal cavity is narrower at a lower, interior portion thereof than at an upper end thereof; and a tip comprising an upper part ending in at least one vertex and a lower part attached to the upper part, wherein the upper part and the lower part adopt the configuration of two cones joined at bases thereof;

wherein the lower part of the tip is received in the second internal cavity.

7. A pellet in accordance with claim 6, wherein the tip comprises an outer hoop and the second internal cavity comprises an internal neck, wherein the outer hoop of the tip is received in the internal neck.

8. A pellet in accordance with claim 7, wherein a portion of the head is crimped around a portion of the tip located above the hoop of the tip.

9. A pellet in accordance with claim 6, wherein the second internal cavity has substantially the same shape as the lower part of the tip.

10. A pellet in accordance with claim 6, wherein the upper part of the tip and the lower part of the tip are symmetrical.

11. A pellet for a sporting rifle or a sporting gun, comprising:

a body having a first internal cavity and a head with a second internal cavity, wherein the second internal cavity has the form of a solid mould or a revolution solid, the faces of which converge at a point or a trunk of said solid mould or revolution solid at a lower, interior portion of the second internal cavity;

a tip having an upper part ending in at least one vertex and a lower part, wherein the upper part and lower part adopt the configuration of two pyramids joined at bases thereof, and wherein the lower part of the tip is received in the second internal cavity.

12. A pellet in accordance with claim 11, characterised in that the tip comprises an outer hoop and the second internal cavity comprises an internal neck in the form of a hoop such that the outer hoop of the tip is received in the internal neck.

13. A pellet in accordance with claim 12, wherein a portion of the head is crimped around a portion of the tip located above the hoop of the tip.

14. A pellet in accordance with claim 11, wherein the second internal cavity has substantially the same shape as the lower part of the tip.

15. A pellet in accordance with claim 11, wherein the upper part of the tip and the lower part of the tip are symmetrical.

16. A pellet for a sporting rifle or a sporting gun, comprising:

a body comprising a first internal cavity and a head comprising a second internal cavity, wherein the second internal cavity comprises at least one side that is tapered such that the second internal cavity is narrower at a lower, interior portion thereof than at an upper end thereof; and a tip comprising an upper part ending in at least one vertex and a lower part attached to the upper part, wherein the upper part and the lower part adopt the configuration of two pyramids joined at bases thereof;

wherein the lower part of the tip is received in the second internal cavity.

17. A pellet in accordance with claim 16, wherein the tip comprises an outer hoop and the second internal cavity comprises an internal neck, wherein the outer hoop of the tip is received in the internal neck.

18. A pellet in accordance with claim 17, wherein a portion of the head is crimped around a portion of the tip located above the hoop of the tip.

19. A pellet in accordance with claim 16, wherein the second internal cavity has substantially the same shape as the lower part of the tip.

20. A pellet in accordance with claim 16, wherein the upper part of the tip and the lower part of the tip are symmetrical.

* * * * *